US006328926B1

(12) United States Patent
Sears, Jr.

(10) Patent No.: US 6,328,926 B1
(45) Date of Patent: Dec. 11, 2001

(54) METHOD AND APPARATUS FOR QUICK-HEATING POURING TUBES AND NOZZLES

(75) Inventor: James B. Sears, Jr., Cranberry Township, PA (US)

(73) Assignee: AG Industries, Inc., Coroapolis, PA (US)

( * ) Notice: Subject to any disclaimer, the term of this patent is extended or adjusted under 35 U.S.C. 154(b) by 0 days.

(21) Appl. No.: 09/411,185

(22) Filed: Oct. 1, 1999

(51) Int. Cl.[7] ..... C21B 13/00
(52) U.S. Cl. ..... 266/44; 222/593; 266/286
(58) Field of Search ..... 266/44, 286, 280; 222/593

(56) References Cited

U.S. PATENT DOCUMENTS 4,682,578 * 7/1987 Schmidt ..... 126/91 R
5,190,716 * 3/1993 Bruckner et al. ..... 266/44

* cited by examiner

*Primary Examiner*—Scott Kastler
(74) *Attorney, Agent, or Firm*—Knoble & Yoshida, LLC

(57) ABSTRACT

A method of preparing a pouring tube such as a submerged entry nozzle (SEN) for use in a continuous casting machine includes steps of preheating at least one portion of the pouring tube by exposing the pouring tube to intensive radiative heat transfer; and installing the preheated pouring tube into a continuous casting machine. In the preferred embodiment the source of intensive radiative heat transfer is a high intensity infrared heat source that is capable of preheating the pouring tube to a temperature of up to 2000 degrees F. within seven to ten minutes. This compares with conventional gas preheating techniques that typically take over thirty minutes and thus require many steel producers to keep an SEN on constant preheat. By eliminating this necessity, the pouring tube may be prepared for use more quickly and in an environmentally sounder manner than through conventional preheating processes.

46 Claims, 4 Drawing Sheets

Wheel 26
Frame 24
Cart 22
Support 38
Chamber 36
Insulation 40
Gate seat 42
Seal 14
Pivoting leg 32
Support legs 50
Lift Lever 48
Pivoting handle 16
Sensor 20
Sensor 18
Sensor 34
Sensor 35

60
S
S
70
72
72
72
72
74
74
68
66
64

METHOD AND APPARATUS FOR QUICK-HEATING POURING TUBES AND NOZZLES

BACKGROUND OF THE INVENTION

1. Field of the Invention

This invention relates to the field of molten metal processing and handling. More specifically, the invention relates to an improved method and apparatus for preheating pouring tubes and nozzles, such as submerged entry nozzles for a continuous casting machine.

2. Description of the Related Technology

Production of metals by use of the continuous casting technique has been increasing since its large-scale introduction about thirty-five years ago, and now accounts for a large percentage of the volume of steel, among other metals, produced each year worldwide. Continuous casting machines typically include a mold that has two essentially parallel and opposed wide walls, and two essentially parallel opposed narrow walls that cooperate with the wide walls to define a casting passage of rectangular cross section. Molten metal is supplied continuously into a top end of the casting passage, and the mold is designed to cool the metal so that an outer skin forms before the so-formed slab or strand exits a bottom of the casting passage. Spraying further cools the strand as it travels away from the mold, until it becomes completely solidified. It may then be processed further into an intermediate or finished metal product, such as steel plate, sheeting or coils by traditional techniques such as rolling.

In conventional continuous casting machines, molten steel is teemed from a ladle into a tundish that typically has a one or more of holes defined in its bottom, each of which is connectable to at least one removable submerged entry nozzle (SEN), which is constructed and arranged to guide the flow of molten steel from the tundish into the continuous casting mold. Special refractory slide gate valves and/or stopper rods are usually provided to control the flow of molten metal to and through the submerged entry nozzle. In addition to the submerged entry nozzle, other refractory pouring tubes are associated with the ladle and the tundish, such as ladle shrouds which are employed to protect the molten metal from ambient oxidation during the teeming/casting operations, and nozzles to guide the molten metal through the brick lining the bottom of the tundish. All of these refractory shapes, which may be referred to herein as molten metal contacting elements, are subjected to severe operating conditions and must be able to withstand thermal shock, as well as the chemical/erosive attack of molten steel and slag.

Molten metal contacting elements are commonly made from carbon containing compositions, including one or more refractory grains such as alumina, zirconia, clays, magnesia, silicon carbide, silica or other dense grains having a specific mesh size. These refractories also generally contain significant amounts of carbon in the form of graphite, carbon black, coke and like carbon sources plus a carbonaceous binder derived from sources such as pitch or resin. Such pressed and fired refractory shapes are known to possess good physical properties, particularly thermal shock, making them suitable for use in this severe operating environment.

Molten steels are commonly de-oxidized or "killed" by the addition of aluminum metal, ferromanganese or ferrosilicon. In the common case of aluminum killed steel, the added aluminum will react with dissolved oxygen or iron oxide to form finely dispersed aluminum oxide in the melt, some of which remains as highly dispersed microparticles in the solidified steel while a portion floats into a layer of slag that floats above the molten steel. During continuous casting, this extremely finely dispersed portion of alumina has a tendency to either precipitate out of the molten steel onto the cooler refractory surfaces or react with and bind to the refractory surfaces. This gradual build-up of alumina causes problems in the control of the flow of molten steel and may eventually cause blockage in the pouring nozzles. In addition, molten metal contacting elements such as submerged entry nozzles wear quickly due to factors such as friction and oxidation, and need to be replaced relatively often.

Before a submerged entry nozzle can be replaced, the new nozzle must be preheated in order to minimize thermal stress within the nozzle during start-up and to prevent the molten steel from solidifying within the nozzle before it reaches the mold. Conventionally, this preheating is performed with gas burners, which are directed inside the ports of the nozzle so that the combustion takes place within the nozzle itself. This method of heating takes from 30 to 60 minutes and has the undesired effect of causing oxidation in the inner working surface of the nozzle. It further has the effect of burning off or otherwise weakening the carbonaceous binder within the refractory material, which will ultimately shorten the working life of the nozzle. Elemental carbon is susceptible to air oxidation at temperatures above 500 degrees C. Since submerged entry nozzles often must be replaced on an unscheduled basis as the continuous casting machine operates, it is common for many steelmakers to keep a new submerged entry nozzle at the ready by the continuous casting machine in a constant preheated state to avoid expensive delays. This practice has several environmental and economic drawbacks. First, keeping a new nozzle preheated consumes an enormous amount of energy, which is not recoverable by the steel producer and tends to end up as waste heat that is introduced into the environment. Second, a new nozzle will only remain useful for a limited period of time while it is being kept in the preheated state, before excessive oxidation and binder degradation takes place. As a result, many new nozzles are discarded without ever being used, which represents a significant expense to the steel producer. Others are downgraded to a shorter life expectancy that is commensurate with the amount of extra time the nozzle remains in the preheated state.

A need exists for an improved method and system for preheating molten metal contacting elements such as submerged entry nozzles that is more energy efficient and environmentally and economically sound than methods and systems that have heretofore been known and used.

SUMMARY OF THE INVENTION

Accordingly, it is an object of the invention to provide an improved method and system for preheating molten metal contacting elements such as submerged entry nozzles that is more energy efficient and environmentally and economically sound than methods and systems that have heretofore been known and used.

In order to achieve the above and other objects of the invention, a method of preparing a molten metal contacting element for use in a system of the type that is designed to handle molten metal includes steps of preheating a molten metal contacting element by exposing the molten metal contacting element to intensive radiative beat transfer; and installing the preheated molten metal contacting element into a system of the type that is designed to handle molten metal, whereby the molten metal contacting element may be prepared for use more quickly and in an environmentally sounder manner than through conventional preheating processes.

A method of preparing a pouring tube for use in a continuous casting machine includes, according to a second aspect of the invention steps of preheating at least one portion of a pouring tube by exposing the pouring tube to intensive radiative heat transfer; and installing the preheated pouring tube into a continuous casting machine, whereby the pouring tube may be prepared for use more quickly and in an environmentally sounder manner than through conventional preheating processes.

According to a third aspect of the invention, an apparatus for preheating at least one portion of a molten metal contacting element that is of the type that is usable in a system of the type that is designed to handle molten metal includes radiative structure for emitting a high-intensity infrared radiation; and positioning structure for positioning the radiative structure in a predetermined position with respect to a molten metal contacting element that is of the type that is usable in a system of the type that is designed to handle molten metal, whereby at least one portion of the molten metal contacting element is preheatable via radiative heat transfer from the radiative structure.

According to a fourth aspect of the invention, an apparatus for preheating at least one portion of a pouring tube for use in a continuous casting machine includes radiative structure for emitting a high-intensity infrared radiation; and positioning structure for positioning said radiative structure in a predetermined position with respect to a pouring tube that is of the type that is usable in a continuous casting machine, whereby at least one portion of the pouring tube is preheatable via radiative heat transfer from the radiative structure.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
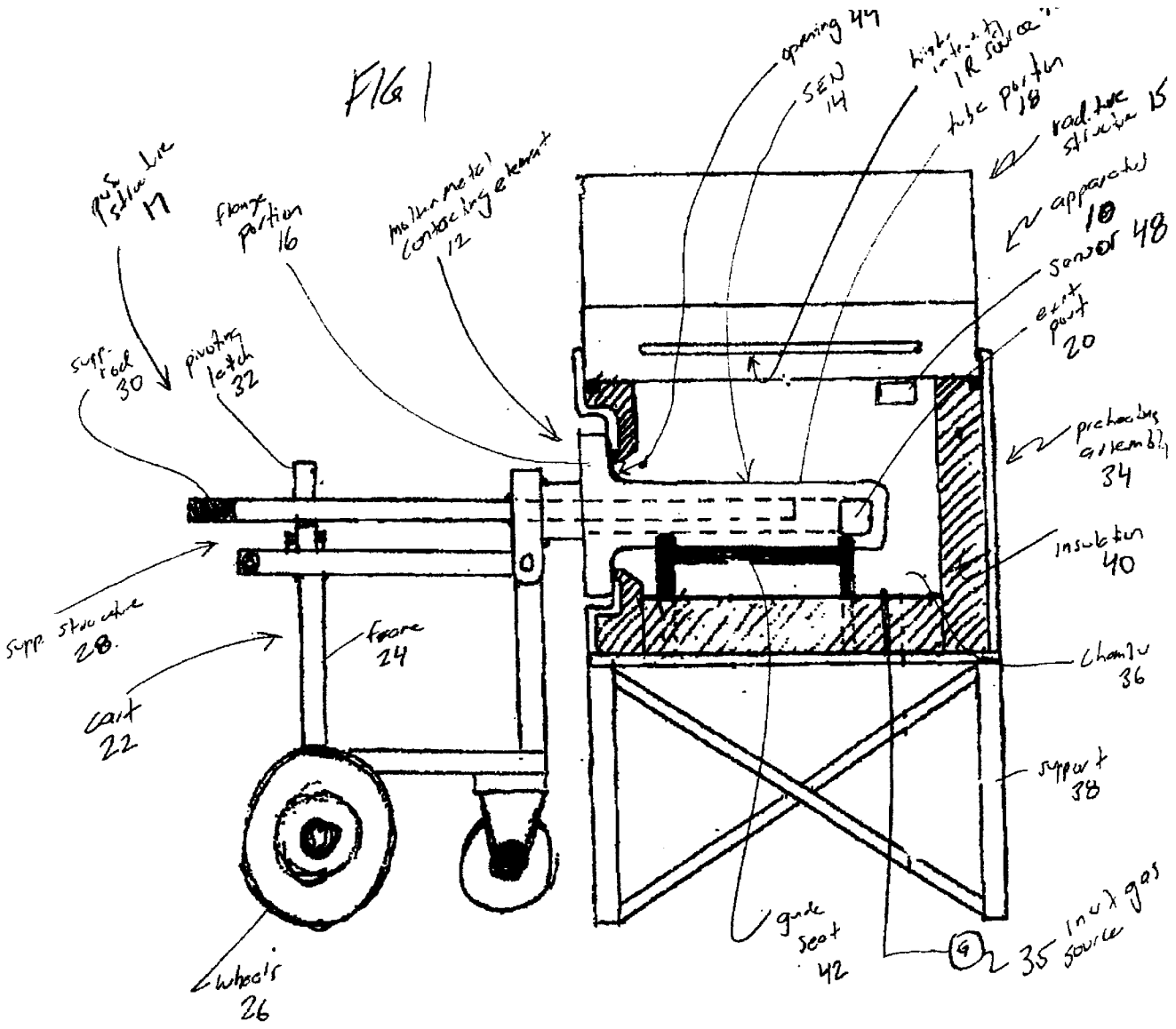
FIG. 1 is a diagrammatical depiction of a system that is constructed according to a preferred embodiment of the invention.

Referring now to the drawings, wherein like reference numerals designate corresponding structure throughout the views, and referring in particular to FIG. 1, an apparatus 10 for preheating at least one portion of a molten metal contacting element 12, which in the preferred embodiment of the invention is a submerged entry nozzle 14, includes radiative structure 15 for emitting a high intensity infrared radiation, and positioning structure 17 for positioning the radiative structure in a predetermined position with respect to the molten metal contacting elements 12 so that at least one portion of the molten metal contacting element 12 is preheatable via radiative transfer from the radiative structure 15. Alternatively, the molten metal contacting element 12 could be any of a number of parts that handle molten metal and that could benefit from preheating, such as a ladle shroud, a tundish nozzle, a pouring nozzle, slide gate valve components and stopper rods. This list is intended to be exemplary, and not exhaustive.

As may be seen in FIG. 1, the submerged entry nozzle 14 is of a common construction, possessing a flange portion 16 of the type of that is commonly encased in metal and that is constructed and arranged to be attached to a tundish, and a tube portion 18 that has a cylindrical internal bore defined therein and at least one exit port 20 at a distal end that is constructed and arranged to permit molten metal to flow therefrom into the continuous casting mold during the continuous casting process.

Figure 6:
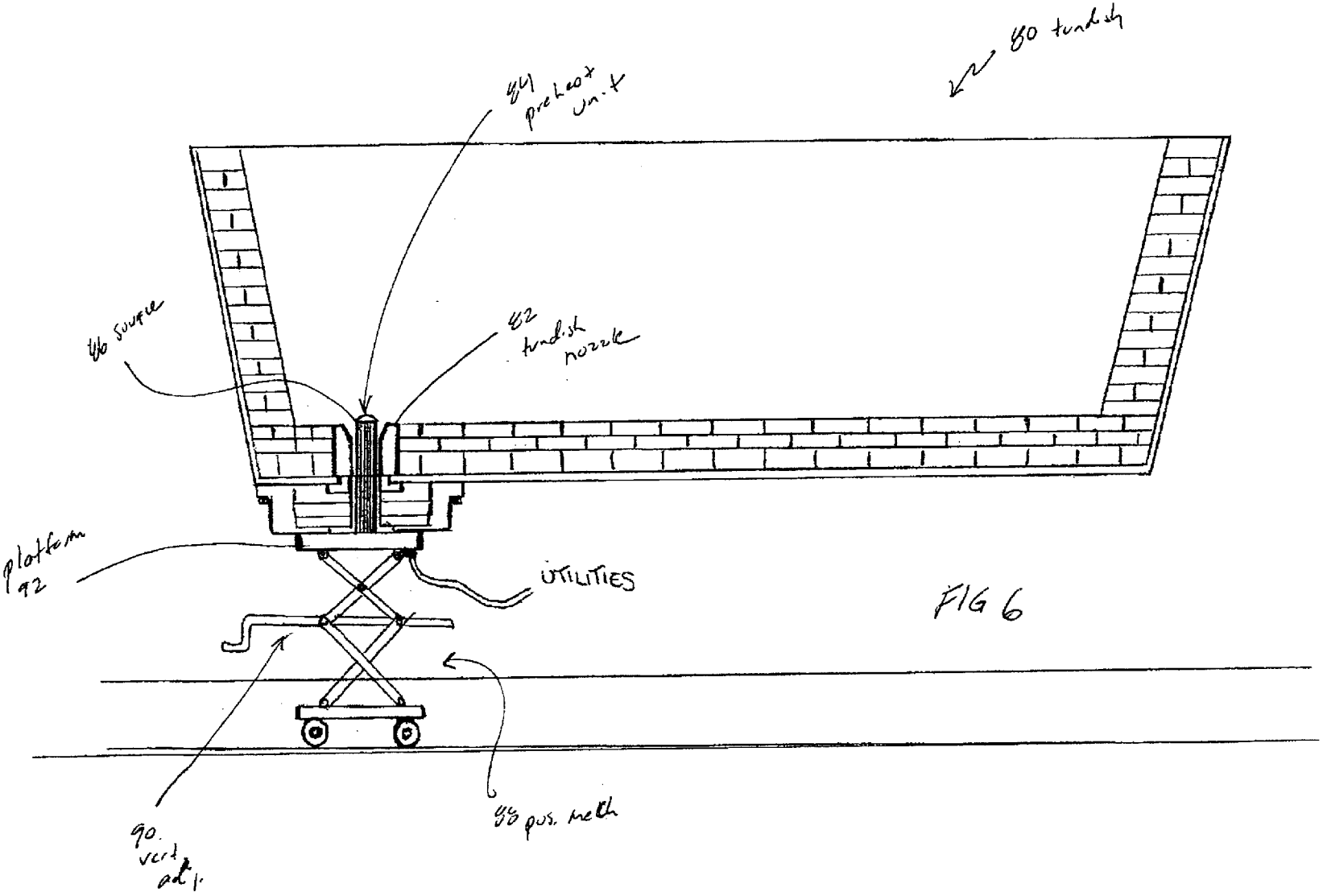
FIG. 6 is a diagrammatical view of a system constructed according to another embodiment of the invention.

Referring again to FIG. 1, positioning structure 17 includes in the preferred embodiment a cart 22 or other vehicle that preferably has a frame 24, a plurality of supporting wheels 26 and a support structure 28 for holding a support rod 30 that extends outwardly from the cart 22 for supporting the submerged entry nozzle 14 in a horizontal position. Although not included in the preferred embodiment that is illustrated, the support structure 28 may include a bearing mechanism for permitting the support rod 30 to be rotated, which also would permit rotation of the submerged entry nozzle 14 within the radiative structure 15. Support structure 28 further includes structure for securing the rod 30 to the cart 22 during operation, which in the preferred embodiment is at least one pivoting latch 32. Alternatively, the support structure could be constructed in such a way (as shown in the embodiment of FIG. 6 discussed below) that the radiative structure 15 could be positioned within the submerged entry nozzle 14 during preheating, so that the submerged entry nozzle 14 may be heated from the inside out.

Radiative structure of 15 is preferably embodied as a preheating assembly 34 that defines a heating chamber 36 that is constructed to substantially surround one or more submerged entry nozzles 14 during the preheating process, as is shown in FIG. 1. Heating chamber 36 is supported at an appropriate elevation with respect to the underlying surface by means of a support structure 38 and is lined with insulation 40, which is preferably fabricated from a thermal ceramic or firebrick material. A guide seat 42 is positioned within the chamber 36 for supporting the submerging entry nozzle 14. Guide seat 42 is preferably fabricated from a metallic material that is resistant to the heat that will be developed within the chamber 36 and that may also act as a conductor of heat and/or re-radiator of infrared heat to the lower side of the submerged entry nozzle 14 during the preheating process. Preferably, guide seat 42 is fabricated from a material such as nickel aluminide or iron aluminide.

As may be seen in FIG. 1, an opening 44 is defined in the chamber 36 to permit the tube portion 18 of the submerged entry nozzle 14 to be positioned within the chamber 36. It is generally considered not desirable to preheat the flange portion 16 to the extent of the rest of the SEN, which is typically encased in a metallic material. A source 35 of pressurized inert gas, preferably argon or nitrogen, is provided to provide a slight positive pressure of the inert gas within the chamber 36. This is to prevent oxidation of the refractory material from which the submerged entry nozzle 14 is fabricated during the preheating process.

According to one important aspect of the invention, a high intensity infrared source 46 is provided in the preheating assembly 34. Preferably, source 46 is of the type that emits infrared energy at a wavelength that is about within the range of 0.75 to 10 microns, that is more preferably within the range of 1 to 5 microns, and is most preferably within the range of 1–2 microns. The infrared source 46 is preferably of the short wave type that has a tungsten filament such as a QH2500T3/CL 460–480VAC 25 inch LL 2500W infrared quartz lamp that is commercially available from General Electric. This short wave emitter operates at a peak wavelength of 1.15 microns.

Figure 3:
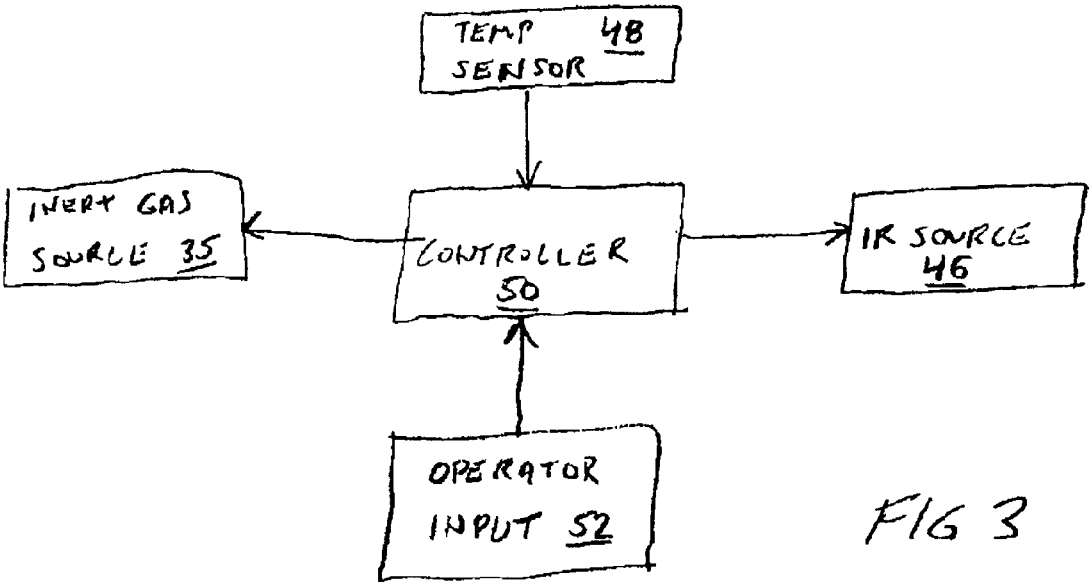
FIG. 3 is a schematic depiction of a control system for the system that is depicted in FIG. 1.

Referring briefly to FIG. 3, it will be seen that a temperature sensor 48 is provided within the preheating assembly 34 in order to sense the temperature of the submerged entry nozzle 14 during the preheating process. Temperature sensor 48 reports this information to a controller 50, which in turn controls operation of the infrared source 46. An operator input 52 is also provided to program or override the controller 50 insofar as such factors as the intensity of infrared heat that is to be applied to the submerged entry nozzle, the time for which the infrared radiation should be applied, and the final temperature to which the submerged entry nozzle 14 is to be heated. Alternatively, controller 50 may be constructed so as to be able to communicate with a broader control system for the entire continuous casting machine or subsystems thereof. Controller 50 further controls the application of pressurized inert gas from the source 35 into the chamber 36.

Figures 4, 5:
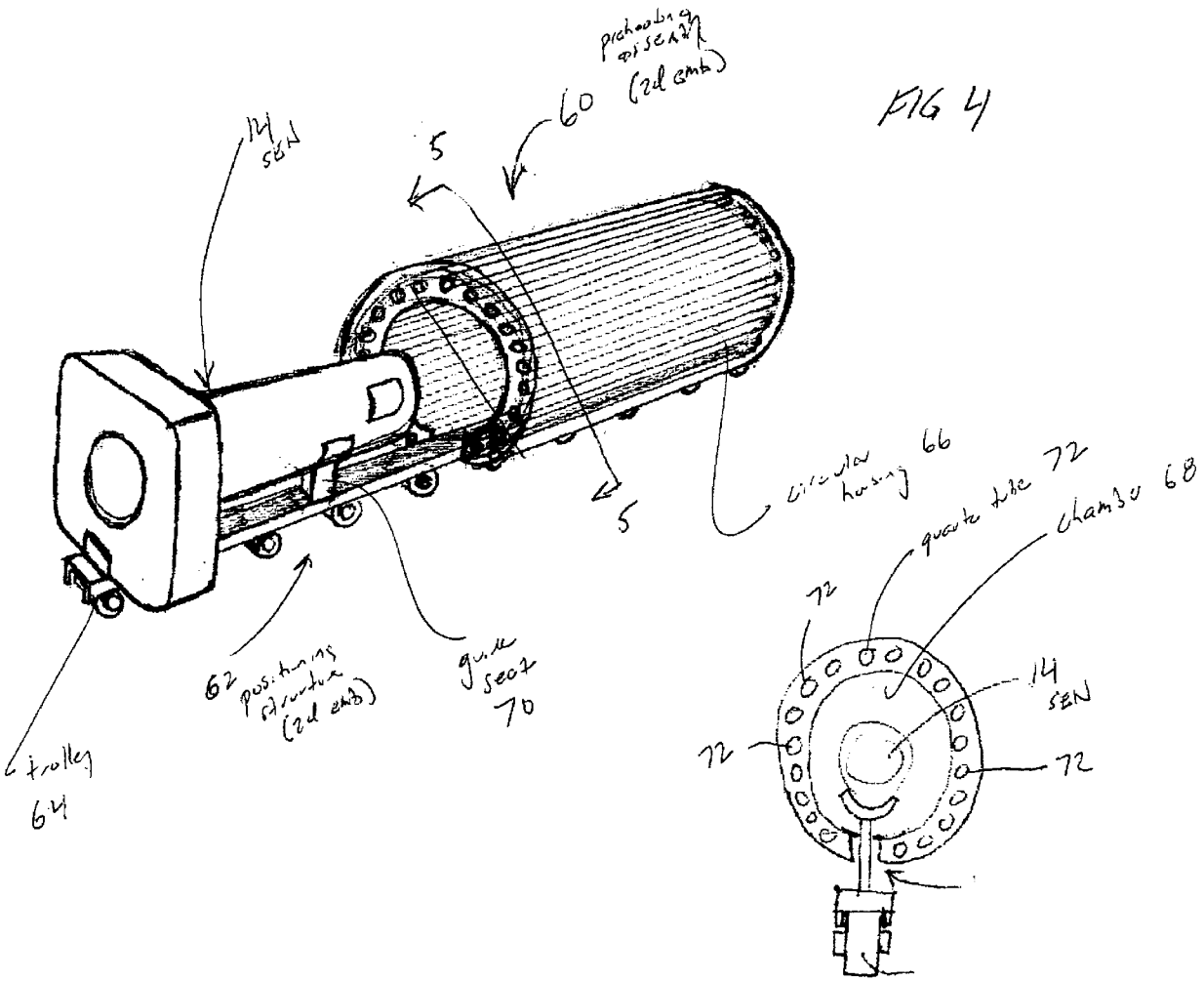
FIG. 4 is a perspective view of a system that is constructed according to an alternative embodiment of the invention.
FIG. 5 is a cross-sectional view taken along lines 5—5 in FIG. 4.

A system that is constructed according to an alternative embodiment of the invention that will be the preferred embodiment in certain circumstances depending on customer preferences is depicted in FIGS. 4 and 5. In this embodiment of the invention, a preheating assembly 60 is provided together with positioning structure 62, which in the illustrated embodiment is constructed as a trolley unit 64. As may be seen in FIG. 4, the preheating assembly 60 includes a generally circular housing 66 defining an internal chamber 68 into which a submerged entry nozzle 14 may be inserted via the positioning structure 62 for preheating. As may be seen in FIG. 5, housing 66 preferably has a slot defined in a lower surface thereof to permit insertion and withdrawal of the positioning structure 62 in to and out of the chamber 68. A guide seat 70 is provided on the trolley unit 64 for supporting the submerged entry nozzle 14.

Figure 2:
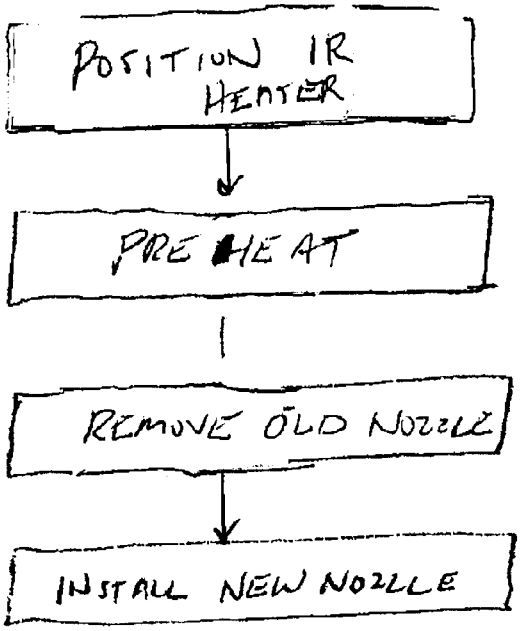
FIG. 2 is a diagrammatical depiction of a process according to the preferred embodiment of the invention.

As may best be seen in FIG. 5, a plurality of high-intensity infrared light sources 72 are provided within the housing 66, and are arrayed so as to substantially surround the portion of the chamber 68 into which the submerged entry nozzle 14 will be positioned for preheating. Through this geometry, the preheating assembly 60 will be able to irradiate the submerged entry nozzle 14 with heat energy at a greater heat flux density and more evenly that with the embodiment that is disclosed in FIGS. 1 and 2.

FIG. 6 depicts an embodiment of the invention wherein a tundish 80 having a tundish nozzle 82 is treated with a preheat unit 84 that is constructed and arranged to be positioned within the tundish nozzle 82 to heat the tundish nozzle 82 prior to startup. In this embodiment, the preheat unit 84 includes at least one but preferably a plurality of infrared sources 86, which are positioned around the outer periphery of the unit 84. The unit 84 may be cooled during operation by an internal water jacket or similar arrangement. As may further be seen in FIG. 6, preheat unit 84 is mounted on a positioning mechanism 88, which includes a platform 92 for supporting the unit 84 and a vertical adjustment mechanism 90 for raising and lowering the unit 84 into and out of the tundish nozzle 82.

In operation, a new molten metal contacting element 12, such as a submerged entry nozzle 14, will be positioned as shown in FIG. 1 within the preheating assembly 34 and will be preheated according to the predetermined conditions that are programmed into controller 50 and to a final temperature that is desired. In the preferred embodiment, preheating is performed by applying infrared radiation to the submerged entry nozzle at a heat flux density at the source 46 that is preferably no less than 10 Watts per square inch, that is more preferably at least 75 Watts per square inch, and that is most preferably at least 100 Watts per square inch. The preheating is preferably performed to reach a temperature that is no less than 1000 degrees F, with a preferable minimum temperature of 1500 degrees F and most preferably to a temperature that is about 2000 degrees F. Preferably, the submerged entry nozzle receives at least 50 percent of its added heat during the preheating process via the radiative mode of heat transfer, as opposed to the convective or conductive modes of heat transfer, and most preferably receives at least 90 percent of its energy through radiative heat transfer. The preheating process is preferably performed in a period of time, measured from the initial application of the high intensity infrared radiation to the submerged entry nozzle to the reaching of the target preheat temperature, of no more than twenty minutes. More preferably, the period of time is no more than fifteen minutes, and most preferably this period of time is no more than ten minutes. It is anticipated that in most instances the preheating process will be able to be preformed within a period of seven to ten minutes.

Alternatively, the submerged entry nozzle 14 may be pre-positioned within the preheating assembly 34 as shown in FIG. 1, with the preheating process commencing at the point in time that it becomes apparent that a nozzle change will have to be made.

At or before this point, an old molten metal contacting element such as a submerged entry nozzle 14 will be removed from the continuous casting machine. The preheated submerged entry nozzle will then be installed in to the continuous casting machine according to conventional techniques.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A method of preparing a molten metal contacting element for use in a system that is designed to handle molten metal, comprising steps of:

(a) preheating a molten metal contacting element by exposing the molten metal contacting element to intensive radiative heat transfer that is generated by a source having a heat flux density of at least 10 watts per square inch, and wherein said preheating is performed so as to heat the molten metal contacting element to a temperature of at least 1000 degrees F. within a period of time that is no greater than 20 minutes; and (b) installing the preheated molten metal contacting element into a system that is designed to handle molten metal, whereby the molten metal contacting element may be prepared for use more quickly and in an environmentally sounder manner than through conventional preheating processes.

2. A method according to claim 1, wherein step (a) comprises subjecting the molten metal contacting element to intensive infrared radiation.

3. A method according to claim 1, wherein the intensive infrared radiation has a heat flux density at a source of the radiation that is at least 75 watts per square inch.

4. A method according to claim 1, wherein the intensive infrared radiation has a heat flux density at a source of the radiation that is at least 100 watts per square inch.

5. A method according to claim 1, wherein step (a) is performed so as to heat the molten metal contacting element to a temperature that is within the range of 1500 degrees F.

6. A method according to claim 1, wherein step (a) is performed so as to heat the molten metal contacting element to a temperature that is within the range of 2000 degrees F.

7. A method according to claim 1, wherein step (a) is further performed so as to heat the molten metal contacting element to said temperature within a period of time that is no greater than fifteen minutes.

8. A method according to claim 7, wherein step (a) is further performed so as to heat the molten metal contacting element to said temperature within a period of time that is no greater than ten minutes.

9. A method according to claim 1, wherein step (a) is performed by positioning the molten metal contacting element within a confined space prior to preheating the molten metal contacting element by exposing the molten metal contacting element to intensive radiative heat transfer.

10. A method according to claim 1, wherein the radiative heat has a wavelength at its source that is within the range of 0.75 to 10 microns.

11. A method according to claim 10, wherein the radiative heat has a wavelength at its source that is within the range of 1 to 5 microns.

12. A method according to claim 11, wherein the radiative heat has a wavelength at its source that is within the range of 1 to 2 microns.

13. A method of preparing a pouring tube for use in a continuous casting machine, comprising steps of:

(a) preheating at least one portion of a pouring tube to a temperature of at least 1000 degrees F. by exposing the pouring tube to electrically generated intensive radiative heat transfer for a period of time that is no more than twenty minutes; and (b) installing the preheated pouring tube into a continuous casting machine, whereby the pouring tube may be prepared for use more quickly and in an environmentally sounder manner than through conventional preheating processes.

14. A method according to claim 13, wherein step (a) comprises subjecting the pouring tube to intensive infrared radiation.

15. A method according to claim 14, wherein the intensive infrared radiation has a heat flux density at a source of the radiation that is at least 10 watts per square inch.

16. A method according to claim 15, wherein the intensive infrared radiation has a heat flux density at a source of the radiation that is at least 75 watts per square inch.

17. A method according to claim 16, wherein the intensive infrared radiation has a heat flux density at a source of the radiation that is at least 100 watts per square inch.

18. A method according to claim 13, wherein step (a) is per formed so as to heat the at least one location on the pouring tube to a temperature that is at least 1500 degrees F.

19. A method according to claim 18, wherein step (a) is performed so as to heat the at least one location on the pouring tube to a temperature that is at least 2000 degrees F.

20. A method according to claim 13, wherein step (a) is futher performed so as to heat the at least one location on the pouring tube to said temperature within a period of time that is no greater than fifteen minutes.

21. A method according to claim 20, wherein step (a) is further performed so as to heat the at least one location on the pouring tube to said temperature within a period of time that is no greater than ten minutes.

22. A method according to claim 13, wherein step (a) is performed by positioning the pouring tube within a confined space prior to preheating the pouring tube by exposing the pouring tube to intensive radiative heat transfer.

23. A method according to claim 13, wherein said pouring tube comprises a submerged entry nozzle for a continuous casting machine.

24. A method according to claim 13, wherein the radiative heat has a wavelength at its source that is within the range of 0.75 to 10 microns.

25. A method according to claim 24, wherein the radiative heat has a wavelength at its source that is within the range of 1 to 5 microns.

26. A method according to claim 25, wherein the radiative heat has a wavelength at its source that is within the range of 1 to 2 microns.

27. An apparatus for preheating at least one portion of a molten metal contacting element that is usable in a system that is designed to handle molten metal, comprising:

radiative means for emitting a high-intensity infrared radiation, said radiative means being constructed and arranged to emit infrared radiation at an intensity that has a heat flux density at a source of the radiation that is at least 10 watts per square inch; and positioning means for positioning said radiative means in a predetermined position with respect to a molten metal contacting element that is usable in a system that is designed to handle molten metal, whereby at least one portion of the molten metal contacting element is preheatable via radiative heat transfer from said radiative means, and wherein said radiative means and said positioning means are constructed and arranged so that said heat energy reaching said molten metal contacting element during use will be at least 50 percent transmitted via radiation.

28. An apparatus according to claim 27, wherein said radiative means is constructed and arranged to emit infrared radiation at an intensity that has a heat flux density at a source of the radiation that is at least 75 watts per square inch.

29. An apparatus according to claim 28, wherein said radiative means is constructed and arranged to emit infrared radiation at an intensity that radiation has a heat flux density at a source of the radiation that is at least 100 watts per square inch.

30. An apparatus according to claim 27, wherein said positioning means comprises containment means for at least partially surrounding said molten metal contacting element during use.

31. An apparatus according to claim 27, wherein said radiative means and said positioning means are constructed and arranged to preheat said molten metal contacting element to a temperature of at least 1000 degrees F.

32. An apparatus according to claim 31, wherein said radiative means and said positioning means are constructed and arranged to preheat said molten metal contacting element to a temperature of at least 1500 degrees F.

33. An apparatus according to claim 32, wherein said radiative means and said positioning means are constructed and arranged to preheat said molten metal contacting element to a temperature of at least 2000 degrees F.

34. An apparatus according to claim 27 wherein the radiative heat has a wavelength at its source that is within the range of 0.75 to 10 microns.

35. An apparatus according to claim 34, wherein the radiative heat has a wavelength at its source that is within the range of 1 to 5 microns.

36. An apparatus according to claim 35, wherein the radiative heat has a wavelength at its source that is within the range of 1 to 2 microns.

37. An apparatus for preheating at least one portion of a pouring tube for use in a continuous casting machine, comprising:

radiative means for emitting a high-intensity infrared radiation; and positioning means for positioning said radiative means in a predetermined position with respect to a pouring tube that is usable in a continuous casting machine, said positioning means comprising containment means for at least partially surrounding said pouring tube during use, said radiative means and said positioning means further being constructed and arranged so that said heat energy reaching said pouring tube during use will be at least 50 percent transmitted via radiation, whereby at least one portion of the pouring tube is preheatable via radiative heat transfer from said radiative means.

38. An apparatus according to claim 37, wherein said radiative means is constructed and arranged to emit infrared radiation at an intensity that radiation has a heat flux density at a source of the radiation that is at least 10 watts per square inch.

39. An apparatus according to claim 38, wherein said radiative means is constructed and arranged to emit infrared radiation at an intensity that radiation has a heat flux density at a source of the radiation that is at least 75 watts per square inch.

40. An apparatus according to claim 39, wherein said radiative means is constructed and arranged to emit infrared radiation at an intensity that radiation has a heat flux density at a source of the radiation that is at least 100 watts per square inch.

41. An apparatus according to claim 37, wherein said radiative means and said positioning means are constructed and arranged to preheat said pouring tube to a temperature of at least 1000 degrees F.

42. An apparatus according to claim 41, wherein said radiative means and said positioning means are constructed and arranged to preheat said pouring tube to a temperature of at least 1500 degrees F.

43. An apparatus according to claim 42, wherein said radiative means and said positioning means are constructed and arranged to preheat said pouring tube to a temperature of at least 2000 degrees F.

44. An apparatus according to claim 37, wherein the radiative heat has a wavelength at its source that is within the range of 0.75 to 10 microns.

45. An apparatus according to claim 44, wherein the radiative heat has a wavelength at its source that is within the range of 1 to 5 microns.

46. An apparatus according to claim 45, wherein the radiative heat has a wavelength at its source that is within the range of 1 to 2 microns.

* * * * *